US007562877B1

(12) United States Patent
Hess

(10) Patent No.: US 7,562,877 B1
(45) Date of Patent: Jul. 21, 2009

(54) TWO HAND TWENTY-ONE WAGERING GAME

(76) Inventor: Richard F. Hess, Las Vegas, NV (US); Teresa Lyn Hess, legal representative, 7370 Falcon Rock Dr., Las Vegas, NV (US) 89123-1469

( * ) Notice: Subject to any disclaimer, the term of this patent is extended or adjusted under 35 U.S.C. 154(b) by 0 days.

(21) Appl. No.: 12/115,524

(22) Filed: May 5, 2008

Related U.S. Application Data

(60) Provisional application No. 60/916,277, filed on May 5, 2007, provisional application No. 60/982,125, filed on Oct. 23, 2007.

(51) Int. Cl.
*A63F 1/00* (2006.01)

(52) U.S. Cl. ..... 273/292; 273/274

(58) Field of Classification Search ..... 273/292, 273/274, 309; 463/13, 12
See application file for complete search history.

(56) References Cited

U.S. PATENT DOCUMENTS 5,377,993 A * 1/1995 Josephs ..... 463/12
5,873,571 A * 2/1999 Vaisman et al. ..... 273/292
5,988,643 A * 11/1999 Awada ..... 273/292
6,481,717 B1 * 11/2002 Richardelle ..... 273/292
6,543,773 B2 * 4/2003 Mims ..... 273/292
6,863,274 B2 * 3/2005 Webb ..... 273/274
7,222,855 B2 * 5/2007 Sorge ..... 273/292
2002/0113371 A1 * 8/2002 Snow ..... 273/292

* cited by examiner

*Primary Examiner*—Benjamin H Layno
(74) *Attorney, Agent, or Firm*—John C. Lambertsen; Kenehan & Lambertsen, Ltd.

(57) ABSTRACT

A method of playing a blackjack game permits a player to place two wagers, obtaining two blackjack hands, and a bonus wager to participate in a side bet. A dealer deals two up cards for each of the two wagers, and the side bet is resolved by evaluating the 4 up-cards in accordance with a predetermined hierarch of winning poker results. An alternative manner of play includes the dealer's up-card with the 4 up-cards of the player, with resolution obtained utilizing winning 5-card poker results.

11 Claims, 9 Drawing Sheets

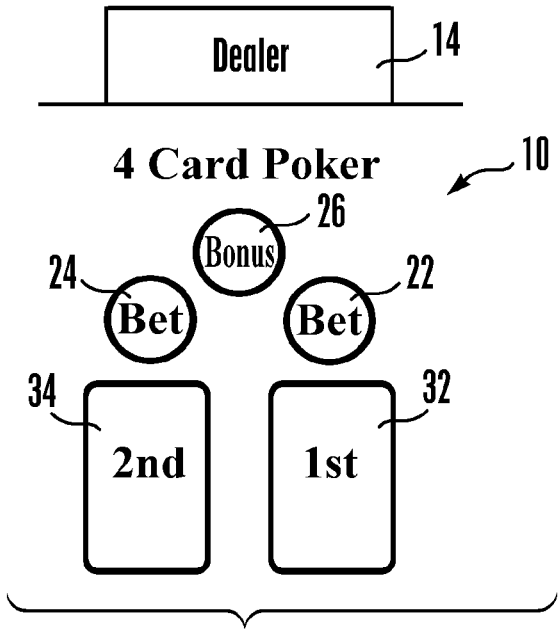
Figure 1
Figure 2
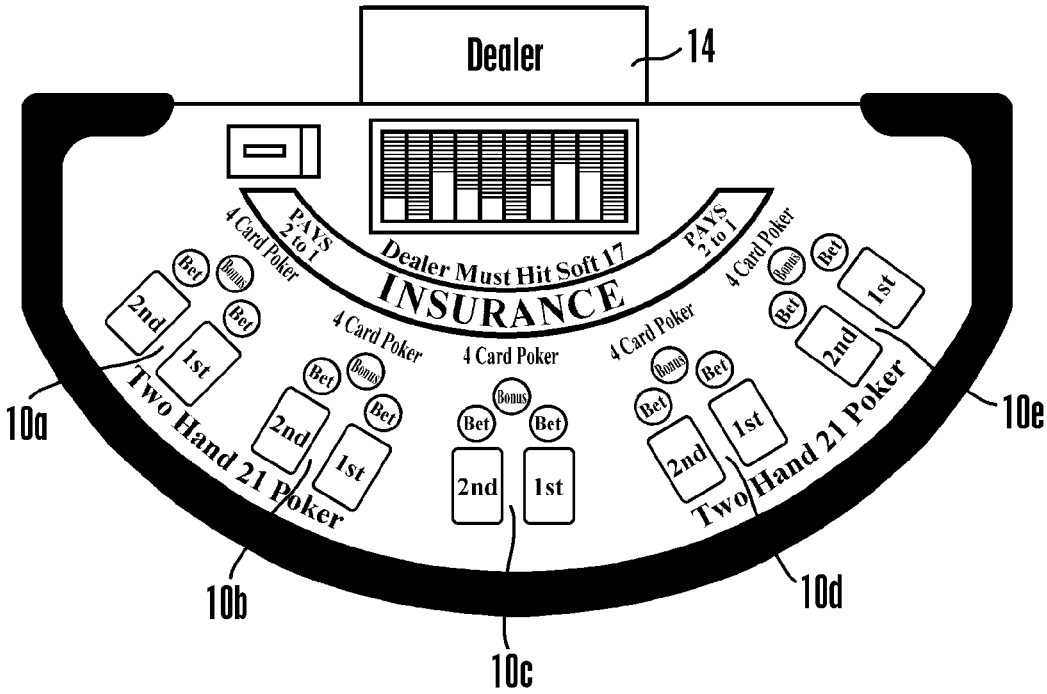

Figure 3
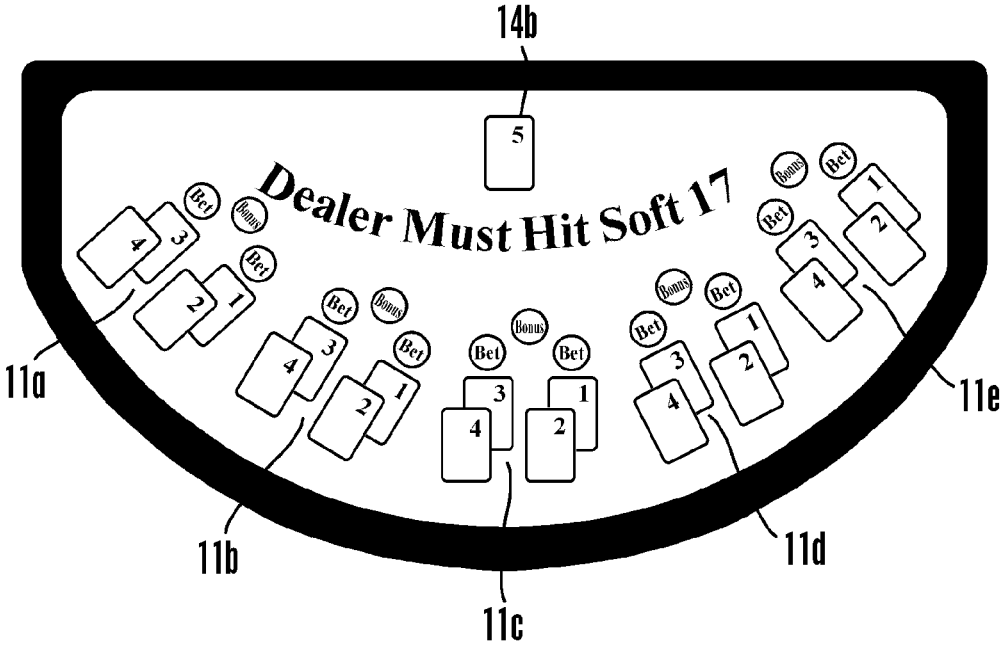
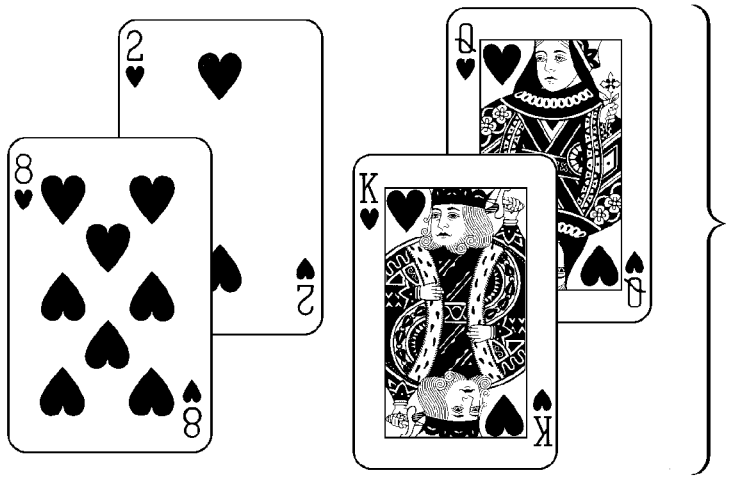
Figure 4

TWO HAND TWENTY-ONE WAGERING GAME

RELATED APPLICATIONS

The present application claims priority under 35 USC §119 (e) to U.S. Provisional Patents, Ser. No. 60/916,277 filed May 5, 2007, and Ser. No. 60/982,125 filed Oct. 23, 2007, which are both incorporated by reference herein.

BACKGROUND OF THE INVENTION

1. Field of the Invention

This invention is in the field of gaming and, more particularly, wagering games using playing cards or images of playing cards. More specifically, the present invention relates to playing card games and methods of play for a blackjack-type card game.

2. Description of the Prior Art

For the past 100 years "Blackjack" or "21" has been the most popular casino table game in the United States. A player's objective in blackjack is to obtain a hand of cards having point values totaling as close to 21 as possible, without going over. After initial bets are placed, players are dealt two cards each, typically face up. Numbered cards are counted at the face value, face cards are counted as "10," and Aces can count as either "1" or "11."

An Ace and a card counting as "10" dealt as the initial two cards are defined to be a "blackjack," and unless the dealer is also dealt a blackjack, that player is entitled to an enhanced payout on wagers placed. The play proceeds around the table, with players choosing to draw additional cards ("hit") to increase their point total or stay with their current cards ("stand").

The dealer also obtains two cards, but typically only the first card is revealed. After all players have completed play, the dealer turns over the hidden, second card, and then begins play of the hand. Unlike the players, the dealer is required to play according to strict rules determining whether to hit or stand. Should the dealer bust (exceed a point total of "21"), each player who did not bust wins. When the dealer does not bust, the value of each non-busting player hand is compared to the dealer's hand, and the player wins if their point total exceeds that of the Dealer.

The popularity of "Blackjack" or "21" is likely due to a variety of factors, including: not many rules of play; it is based upon skill not just luck; and minimum bets can be small without affecting the odds of winning. It would be desirable to create additional betting excitement for Blackjack players while increasing revenue yield for casinos—yet utilize the present casino Blackjack personnel and floor space, and minimize the complexity of any additional rules of play.

SUMMARY OF THE INVENTION

According to aspects of embodiment of the present invention, a method of playing a wagering game, comprising: placing a first wager to participate in a first casino blackjack game; placing a second wager to participate in a second casino blackjack game; placing a third wager to participate in a side bet; a dealer deals four face-up cards for said first and said second casino blackjack games and a single face-up card and a single face-down card for said dealer; and resolving said side bet by evaluating said four face-up cards for said first and said second casino blackjack games according to a predetermined hierarchy of poker hands.

Another aspect in accordance with embodiments of the present invention wherein said resolving said side bet further includes combining said single face-up card for said dealer with said four face-up cards for said first and said second casino blackjack games according to a predetermined hierarchy of 5-card poker hands.

A further aspect in accordance with embodiments of the present invention is a method of playing a blackjack game between at least one player and a dealer using at least one standard deck of playing cards, comprising the steps of: each player placing a first wager, optionally placing a second wager, and optionally placing a bonus wager; dealing each player placing a first wager an initial hand of two face-up playing cards, dealing each player placing a second water an initial hand of two face-up playing cards, and dealing an initial hand of two playing cards to the dealer, a first card face-up and a second card face down; and resolving said optional bonus wager by evaluating said initial face-up cards of a player dealt for placing said first wager and said optional second wager according to a predetermined hierarchy of poker hands.

A still further aspect in accordance with embodiments of the present invention, wherein the resolution of said optional bonus wager further includes adding said initial face-up card of said dealer and evaluating according to a pre-determined hierarchy of 5-card poker hands.

These and various other advantages and features of the present invention are pointed out with particularity in the claims. Reference should also be had to the drawings which form a further part hereof, as well as to the accompanying descriptive matter in which are illustrated and described various examples of the invention.

BRIEF DESCRIPTION OF THE DRAWINGS

FIG. 1 is a partial plan view of a playing position in accordance with a preferred embodiment of the present invention.

FIG. 2 is a plan view of a table layout utilizing the playing position of FIG. 1.

FIG. 3 is a plan view of a table layout utilizing the playing position of FIG. 1 in accordance with an alternative preferred embodiment of the present invention permitting players to use the dealer's up card in achieving a 5-card poker bonus hand.

FIG. 4 is a schematic view of a "flush" winning bonus hand.

DETAILED DESCRIPTION OF THE PREFERRED EMBODIMENTS

Figure 5:
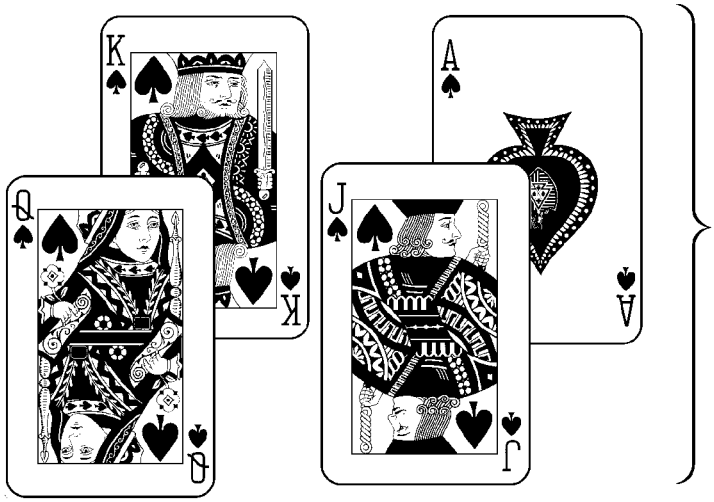
FIG. 5 is a schematic view of a "royal flush" winning bonus hand.

Reference is now made to the drawings wherein like numerals refer to like parts throughout. In FIG. 1, a playing position 10 is provided with a plurality of inscribed geometric shapes to assist in the play of a card game described hereinafter.

Located opposite a dealer position 14, the player position 10 is provided with a wagering area that defines three separate wagers: a first betting area 22; a second betting area 24; and a bonus betting area 26. A first playing card area 32 is located adjacent the first betting area 22 and a second playing card area 34 lies adjacent the second betting area 24. FIG. 2 illustrates a gaming table layout for the present invention having a plurality (here 5) of player positions 10*a*, 10*b*, 10*c*, 10*d*, 10*e*, 10*f*.

FIG. 3 illustrates a gaming table layout for a presently preferred alternative embodiment of the present invention, again having a plurality of player positions 11*a*, 11*b*, 11*c*, 11*d*, 11*e*, 11*f*. Under this alternative embodiment, a bonus-betting player is permitted to utilize a dealer's up-card 14*b* with the player's own four up-cards, to form a conventional 5-card poker hand. Play of this alternative preferred embodiment will be described in greater detail after first describing the embodiment that utilizes only a bonus-betting player's 4 up-cards to define a 4-card poker hand.

A preferred embodiment of the present invention contemplates the use of a single deck of playing cards consisting of a standard deck (minus any joker card) of 52 cards. A player is initially presented an opportunity to place up to three wagers—to place a wager in the bonus betting area 26 requires that the player first place wagers in both the first betting area 22 and the second betting area 24.

After all wagers are placed, the dealer commences the dealing of the playing cards with each player dealt two playing cards, face up, for each of the first and second wagers made. The dealer is likewise dealt two cards; however, only one of the dealer's cards is placed face up. Attention is then directed towards the four up-cards of each player who made a bonus wager. The four up-cards are evaluated in accordance with a poker winning event schedule, an example of which is set forth below.

Figure 6:
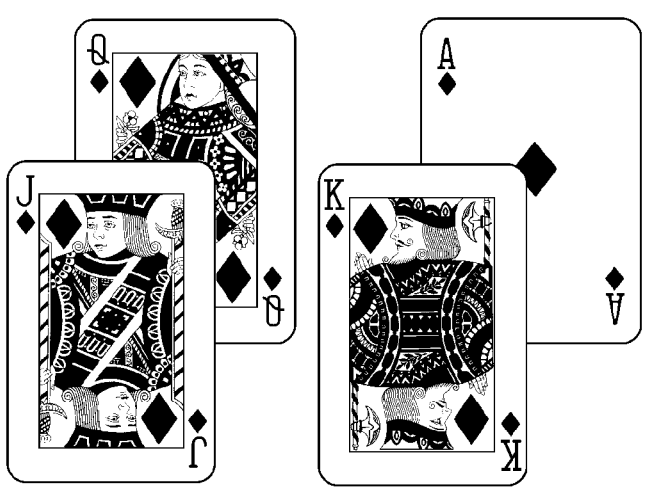
FIG. 6 is a schematic view of a "royal flush" winning bonus hand.
Figure 7:
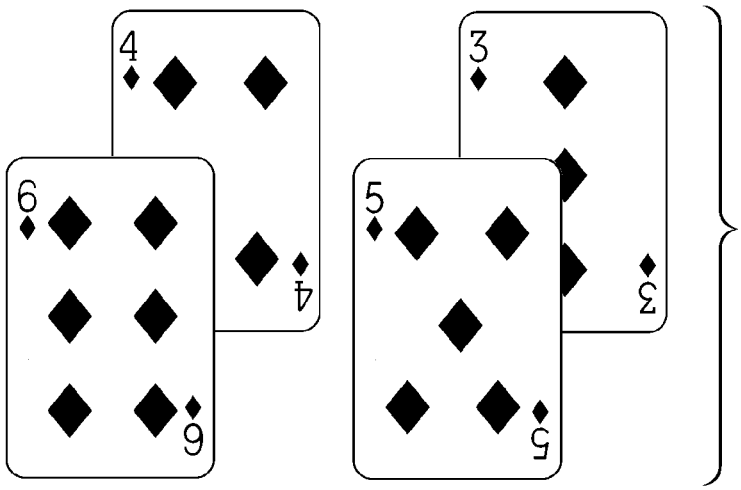
FIG. 7 is a schematic view of a "straight flush" winning bonus hand.
Figure 8:
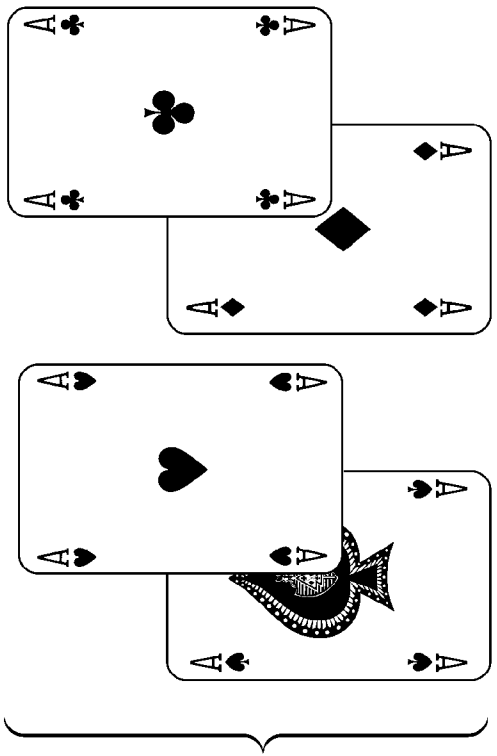
FIG. 8 is a schematic view of a "4 of a kind" winning bonus hand.
Figure 9:
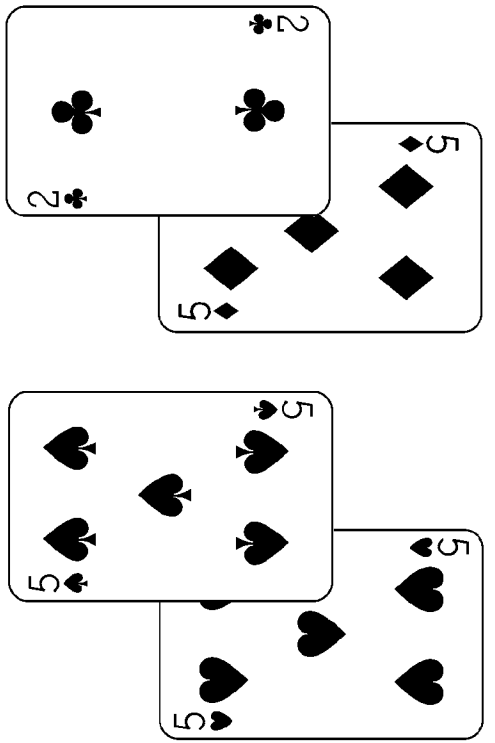
FIG. 9 is a schematic view of a "Three of a Kind" winning bonus hand.
Figure 10:
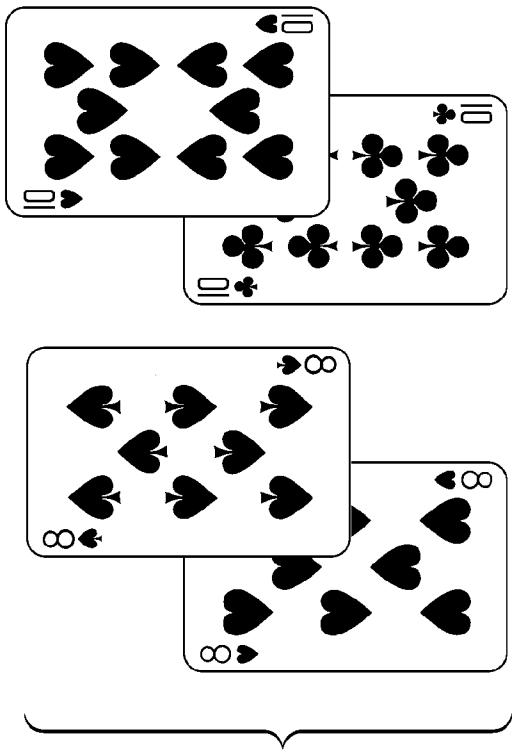
FIG. 10 is a schematic view of a "two pair" winning bonus hand.
Figure 11:
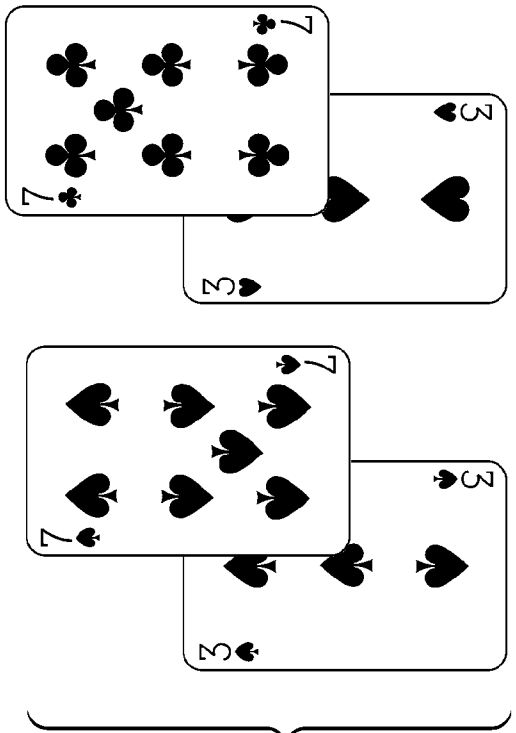
FIG. 11 is a schematic view of an alternative "two pair" winning bonus hand.
Figure 12:
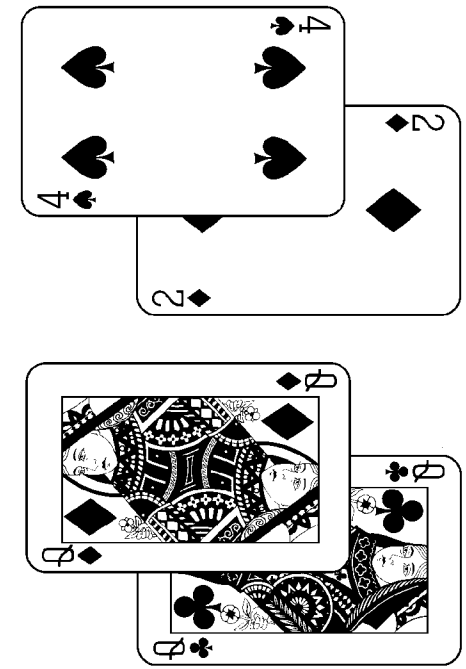
FIG. 12 is a schematic view of a "Jacks or Better" winning bonus hand.
Figure 13:
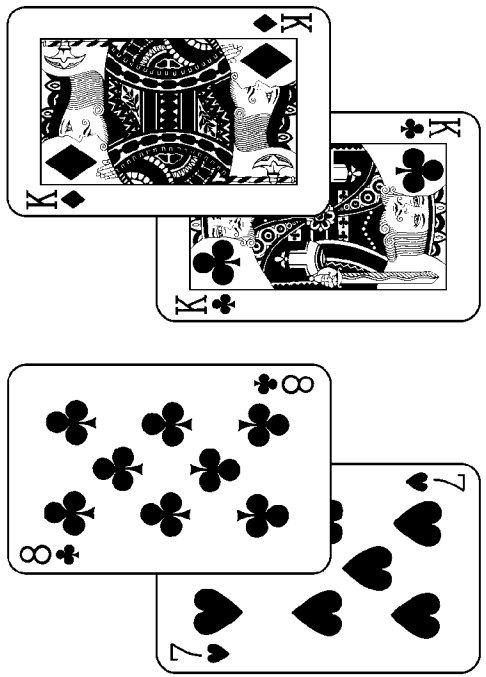
FIG. 13 is a schematic view of an alternative "Jacks or Better" winning bonus hand.
Figure 14:
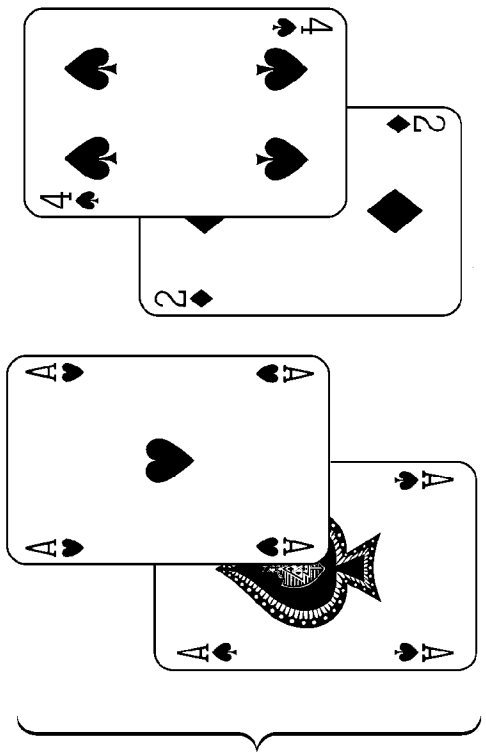
FIG. 14 is a schematic view of a still further alternative "Jacks or Better" winning bonus hand.
Figure 15:
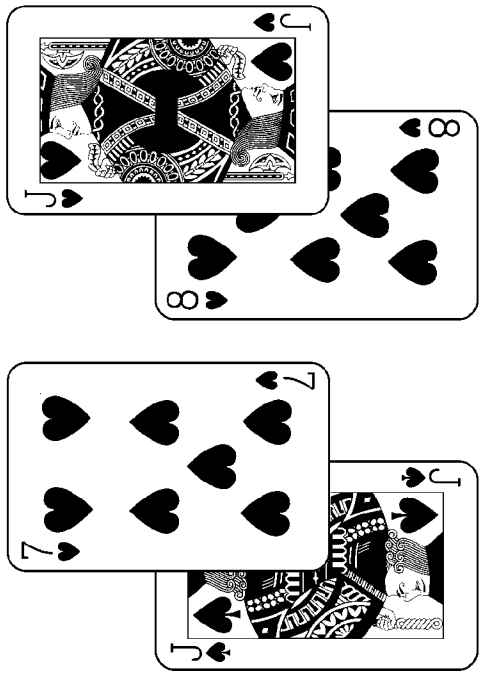
FIG. 15 is a schematic view of a yet still further alternative "Jacks or Better" winning bonus hand.
Figure 16:
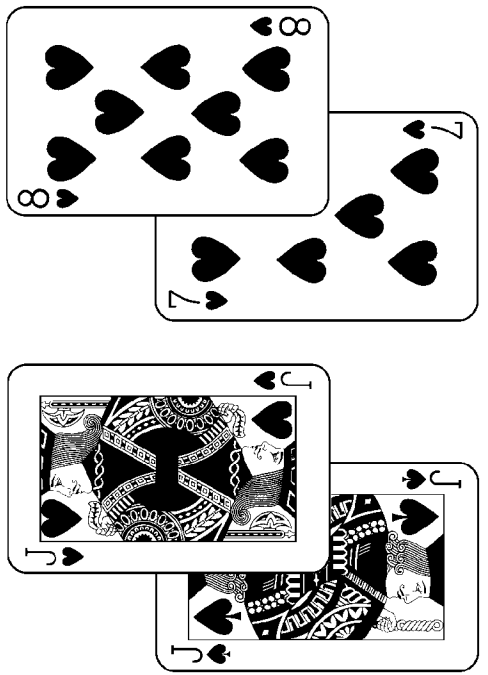
FIG. 16 is a schematic view of a yet still further alternative "Jacks or Better" winning bonus hand.

| Payout Hand | Payout | FIG. No. |
|---|---|---|
| Card Royal Flush | 250 to 1 | FIGS. 5 and 6 |
| 4 Card Straight Flush | 225 to 1 | FIG. 7 |
| 4 of a Kind | 100 to 1 | FIG. 8 |
| 4 Card Flush | 35 to 1 | FIG. 4 |
| 3 of a Kind | 15 to 1 | FIG. 9 |
| Two Pair | 5 to 1 | FIGS. 10-11 |
| Jacks or Better | 1 to 1 | FIGS. 12-16 |

Figure 17:
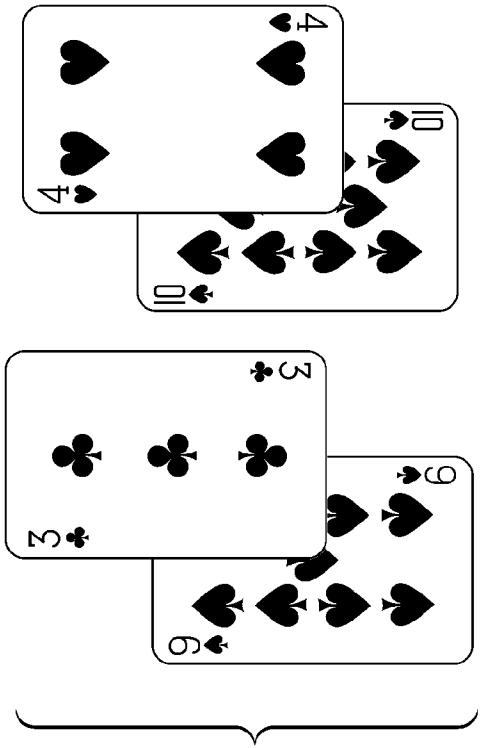
FIG. 17 is a schematic view of a "Non-Winning" or "Losing" bonus hand.
Figure 18:
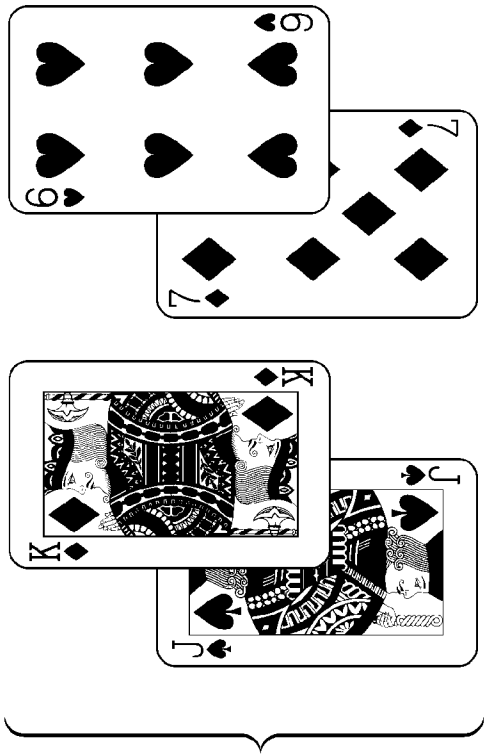
FIG. 18 is a schematic view of a further "Non-Winning" or "Losing" bonus hand.
Figure 19:
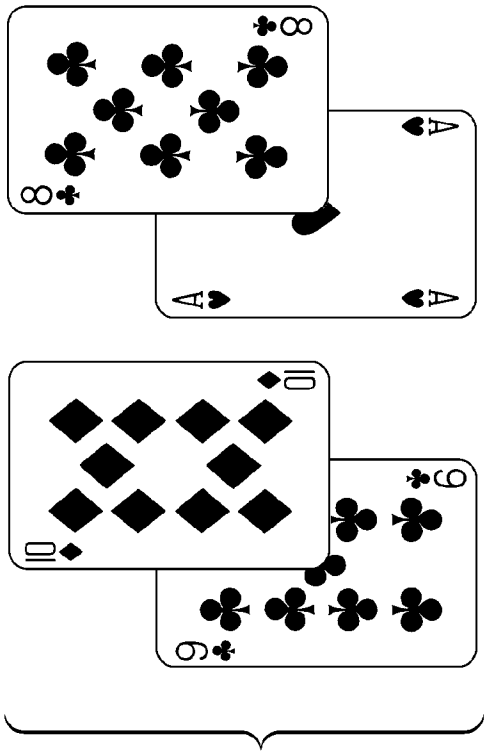
FIG. 19 is a schematic view of a still further "Non-Winning" or "Losing" bonus hand.

Losing hands are depicted in FIGS. 17-19.

Figure 20:
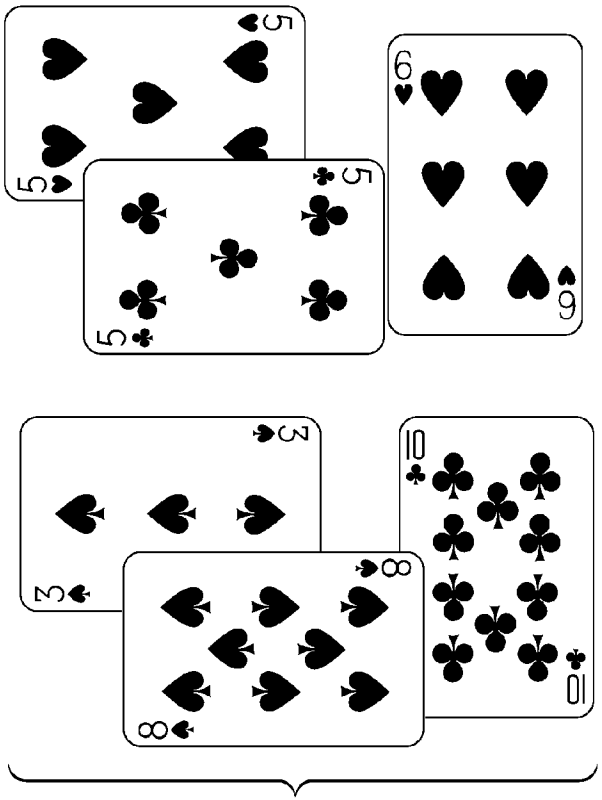
FIG. 20 is a schematic view of a "double down" player-made election.
Figure 21:
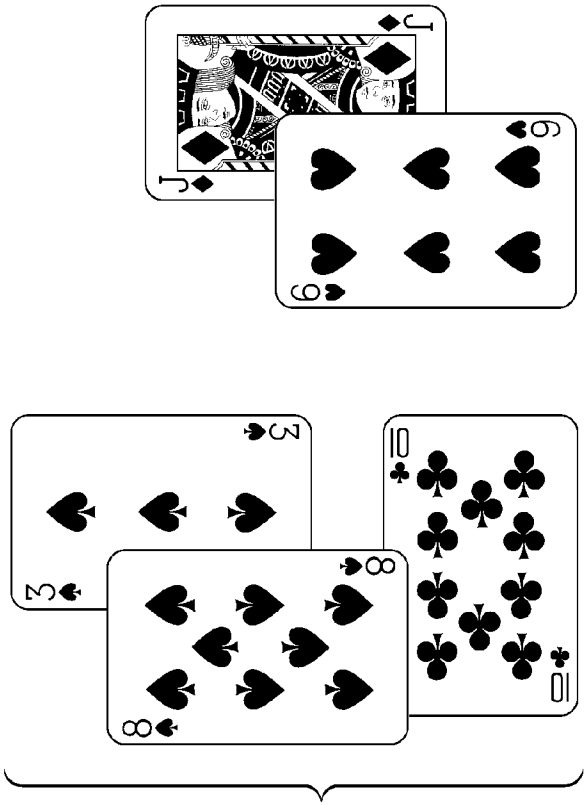
FIG. 21 is a schematic view of a single "double down" player-made election.
Figure 22:
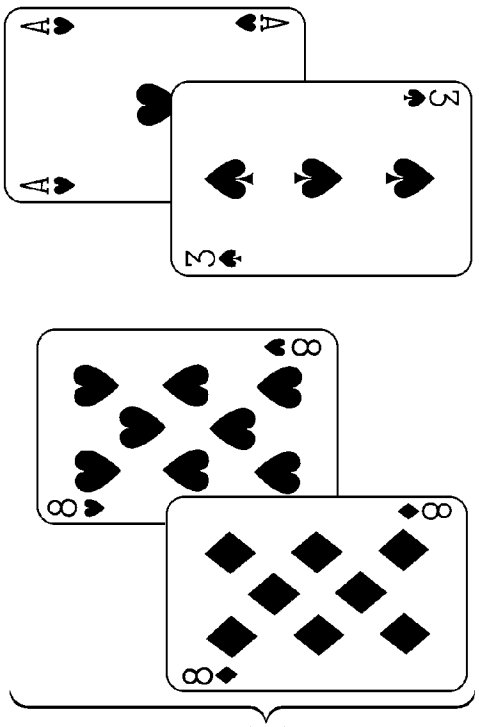
FIG. 22 is a schematic view of a player's hand eligible for "splitting pairs".
Figure 23:
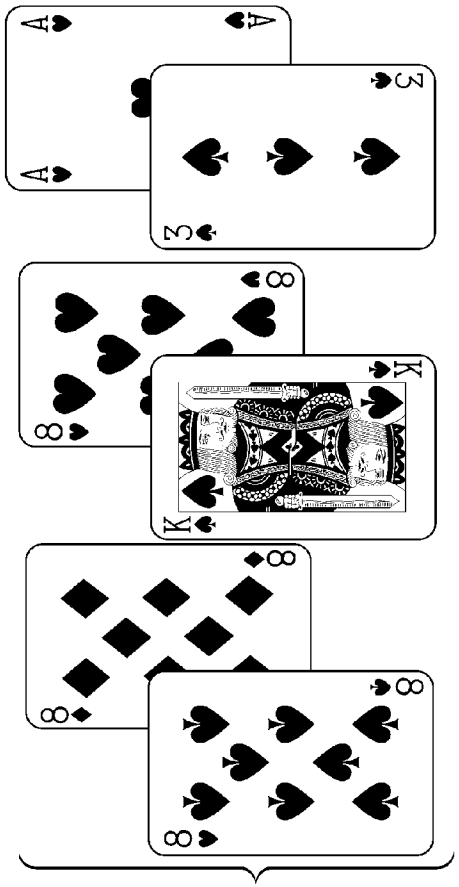
FIG. 23 is a schematic view of a "split pair" with possible further eligibility for "splitting pairs".
Figure 24:
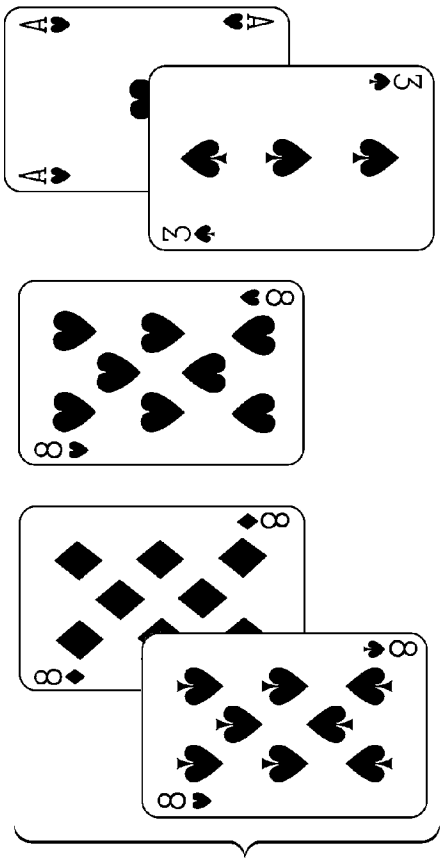
FIG. 24 is a schematic view of a "split pair" having an incomplete player deal.

Any winning payouts are made, and then play resumes in accordance with standard blackjack rules, beginning with the play of the first hand. Once play of the first hand is completed, the player may act on the second hand. Players may only double down on 10 and 11 (see FIGS. 20-21), and may only split once (per hand)—see FIGS. 22-24. As in conventional blackjack, each player's hand plays individually against the dealer's hand. Player's hands may be insured individually, and Blackjack pays 3 to 2. It is further contemplated that the dealer must hit on a soft 17.

Alternative payouts for the bonus wager are also possible, as are other winning events, such as a particular four card poker hand that is posted. As previously stated, the present invention contemplates the use of conventional playing cards, with each deck consisting of 52 playing cards in four suits: spades; hearts; diamonds; and clubs, from the Ace through the King. A single or multiple decks are considered within the scope of the present invention.

The rules and play of the game are described below in a series of examples.

EXAMPLE 1

Player One begins by placement of wagers in the first betting area 22, the second betting area 24—the wagers are equal in amount, and an optional wager in the bonus betting area 26; Player Two places equal wagers in the first betting area 22 and the second betting area 24; and Player Three places a wager in the first betting are 22. Player One is the only player eligible to participate in the bonus feature. The Dealer deals a first card, face up, to each of the three players, placing it in their respective first card playing areas 32. A second card is then dealt to each of the players, with the cards of Player One and Player Two dealt in their respective second playing card areas 34. A third card is then dealt to Player One and Player two in the first playing card area 32, but not Player Three who only placed a wager in the first betting area 22. A fourth card is then dealt to Player One and Player Two and placed in their respective second playing card areas 34. The Dealer has an up 6 card, and a face-down card.

Since Player One placed a bonus wager, the Dealer then evaluates the four cards dealt to Player One: first hand, Ace of Diamonds and King of Diamonds; and second hand, Jack of diamonds and Queen of Diamonds. The up cards of Player One constitute a "Royal Flush" winning bonus hand, and the wager is paid a bonus payout in the amount of 250 to 1. Player Two did not place a bonus wager, so the values of the four cards dealt to Player Two are not evaluated under the published schedule of winning bonus events.

Play of conventional Blackjack or Twenty One then continues, with the Dealer turning over the face-down card—an Ace of Hearts (given the Dealer a soft seventeen) and then beginning with the first of two hand of Player One. The first hand is the Ace and King of Diamonds, which is also a "Blackjack." The Dealer did not have a Blackjack, so the wager of Player One placed in the first betting area 22 is paid 3:2. Play then is directed to the second hand of Player One, a Queen and Jack of Diamonds—totaling 20 points. Player One communicates to the Dealer that no more cards are desired—Player One elects to "stand" on the cards of the second hand.

The cards of Player Two follow, beginning with the first hand of Player Two: an Ace and a six—a "soft seventeen," since the Ace can be evaluated as either one point or eleven points. Player Two elects to stand on the first hand. The second hand of Player Two is a King and a four. Player Two elects to receive another card, a Queen, busting the hand at twenty-four points.

The single hand of Player Three is then in play: Jack and a Three. Player Three elects to receive another card, a Six, and then elects to "Stand" on the resulting nineteen points.

The Dealer has a soft seventeen—Ace and Six, and house rules require the Dealer to "hit" on a soft seventeen. The next card is a five, totaling twenty-two, and the house will now count the Ace as "one" for a total of twelve. At any hard value under sixteen the Dealer is required to hit, and the next card is a King. The Dealer has busted and the second hand of Player One, the first hand of Player Two, and the hand of Player Three win—with even money paid by the Dealer on all wagers made.

EXAMPLE TWO

Player One places equal wagers in the two betting circles and an optional wager in the bonus bet area. The Dealer deals two hands to Player One and a single Dealer hand. The Player One cards are dealt face-up, and consist of an Ace of Diamonds, a two of Spades, a three of Clubs, and a four of Hearts—a "straight" hand in many poker games, but not a winning bonus hand under the presently preferred embodiment.

The Dealer turns over the concealed card, and has a King and Ace—a Blackjack. The Dealer wins and Player One loses on both remaining hands.

EXAMPLE THREE

Player One places wagers in all three betting areas, and is dealt a three of spades and an eight of spades for a first hand, and a Jack of diamonds and a six of hearts for a second hand. There is no winning bonus poker hand. To double down requires hands having point values of ten or eleven, thus, Player One may double down on the first hand, which totals eleven points, but not on the second hand, which totals thirteen. If four decks of cards are in use, the player may double down on any two first cards.

EXAMPLE FOUR

Player One places wagers in all three betting areas, and is dealt a first hand consisting of an eight of hearts and an eight of diamonds, and a second hand consisting of an Ace of hearts and a three of spades. There is no winning bonus poker hand. Player One may split the pairs of eights. If another eight is drawn to one of the split pairs, Player One may not declare another split. If four decks of cards are in use, the player may split pairs up to four times.

A presently preferred alternative version of the present invention permits use of the Dealer's up card in forming the bonus poker hand—which now consists of five (5) cards.

The rules and play of this alternative version are described below in a series of examples.

EXAMPLE 1

Player One begins by placement of wagers in the first betting area 22, the second betting area 24—the wagers are equal in amount, and an optional wager in the bonus betting area 26; Player Two places equal wagers in the first betting area 22 and the second betting area 24; and Player Three places a wager in the first betting are 22. Player One is the only player eligible to participate in the bonus feature. The Dealer deals a first card, face up, to each of the three players, placing it in their respective first card playing areas 32. A second card is then dealt to each of the players, with the cards of Player One and Player Two dealt in their respective second playing card areas 34. A third card is then dealt to Player One and Player two in the first playing card area 32, but not Player Three who only placed a wager in the first betting area 22. A fourth card is then dealt to Player One and Player Two and placed in their respective second playing card areas 34. The Dealer has a ten of Diamonds up card, and a face-down card.

Since Player One placed a bonus wager, the Dealer then evaluates the four cards dealt to Player One, plus the Dealer's up card (ten of Diamonds): first hand, Ace of Diamonds and King of Diamonds; and second hand, Jack of diamonds and Queen of Diamonds. The up cards of Player One constitute a "Royal Flush" winning bonus hand: Ace, King, Queen, Jack of Diamonds, and the Dealer's 10 of Diamonds. The bonus wager is paid a bonus payout in the amount of 250 to 1. Player Two did not place a bonus wager, so the values of the four cards dealt to Player Two are not evaluated under the published schedule of winning bonus events.

Play of conventional Blackjack or Twenty One then continues, with the Dealer turning over the face-down card—a ten of Hearts (giving the Dealer a twenty) and then beginning with the first of two hands of Player One. The first hand is the Ace and King of Diamonds, which is also a "Blackjack." The Dealer did not have a Blackjack, so the wager of Player One placed in the first betting area 22 is paid 3:2. Play then is directed to the second hand of Player One, a Queen and Jack of Diamonds—totaling 20 points. Player One communicates to the Dealer that no more cards are desired—Player One elects to "stand" on the cards (totaling 20 points) of the second hand.

The cards of Player Two follow, beginning with the first hand of Player Two: an Ace and a six—a "soft seventeen," since the Ace can be evaluated as either one point or eleven points. Player Two elects to stand on the first hand. The second hand of Player Two is a King and a four. Player Two elects to receive another card, a Queen, busting the hand at twenty-four points.

The single hand of Player Three is then in play: Jack and a Three. Player Three elects to receive another card, a Six, and then elects to "Stand" on the resulting nineteen points.

The Dealer has a twenty (two tens) and stands. The second hand of Player One ties the Dealer's hand of twenty, resulting in a "standoff" or "tie," and Player One neither collects nor loses. Player Two's first hand totals 17, and Player Two loses. Player Three's hand totals 19, and Player Three loses, and play of that game concludes with the conclusion of the pay/collection settlement.

If the Dealer had had a soft seventeen—Ace and Six, most house rules require the Dealer to "hit" on a soft seventeen. The next card is a five, totaling twenty-two, and the house will now count the Ace as "one" for a total of twelve. At any hard value under sixteen the Dealer is required to hit, and the next card is a King. The Dealer has busted and the second hand of Player One, the first hand of Player Two, and the hand of Player Three win—with even money paid by the Dealer on all wagers made.

EXAMPLE TWO

Player One places equal wagers in the two betting circles and an optional wager in the bonus bet area. The Dealer deals two hands to Player One and a single Dealer hand with a five of Diamonds up card. The cards of Player One are dealt face-up, and consist of an Ace of Diamonds, a two of Spades, a three of Clubs, and a four of Hearts. Player One's cards, together with the five of Diamonds Dealer up card, compose a "straight" hand—a winning bonus hand under the presently preferred alternative embodiment.

The Dealer turns over the concealed card, an Ace, and accepts a hit, a five of Hearts, making twenty one. The Dealer wins and Player One loses on both remaining hands.

EXAMPLE THREE

Player One places wagers in all three betting areas, and is dealt a three of Spades and an eight of Spades for a first hand, and a Jack of Diamonds and a six of Hearts for a second hand. The Dealer's up card is an Ace of Spades. There is no winning bonus poker hand. To double down requires hands having point values of ten or eleven, thus, Player One may double down on the first hand, which totals eleven points, but not on the second hand, which totals thirteen. If four decks or six decks of cards are in use, the player may double down on any two first cards.

EXAMPLE FOUR

Player One places wagers in all three betting areas, and is dealt a first hand consisting of an eight of Hearts and an eight of Diamonds, and a second hand consisting of an Ace of Hearts and a three of Spades. The Dealer's up card is a four of Clubs. There is no winning bonus poker hand. Player One may split the pair of eights. If another eight is drawn to one of the split pairs, Player One may not declare another split. If four decks or six decks of cards are in use, the player may split pairs up to four times.

EXAMPLE FIVE

Player One places equal wagers in the two betting circles and an optional wager in the bonus bet area. The Dealer deals two hands to Player One and a single Dealer hand. The Player One cards are dealt face-up, and consist of an Ace of Clubs, a two of Hearts, a six of Clubs, and a four of Spades. The Dealer's up card is a King of Diamonds. In combination, these cards are a non-winning combination under the presently preferred alternative embodiment of the present invention. The Dealer turns over the concealed card, an Ace of Spades—a Blackjack. The Dealer wins and Player One loses on both remaining hands.

As noted in the examples, the winning events are slightly modified in the alternative preferred embodiment, and such events, along with associated odds, are reproduced in the two tables, below.

| Payout Hand | Payout |
|---|---|
| 5 CARD PAY TABLES (SINGLE DECK) | |
| Royal Flush | 250 to 1 |
| Straight Flush | 200 to 1 |
| 4 of a Kind | 100 to 1 |
| Flush | 35 to 1 |
| Straight | 20 to 1 |
| 3 of a Kind | 5 to 1 |
| Two Pairs | 2 to 1 |
| Jacks or Better (Single Pair) | 1 to 1 |
| 5 CARD PAY TABLES (SIX DECKS) | |
| 5 Suited Aces | 250 to 1 |
| 5 Suited Cards (not Aces) | 225 to 1 |
| 5 of a Kind (not Suited) | 200 to 1 |
| Royal Flush | 175 to 1 |
| Straight Flush | 125 to 1 |
| 4 of a Kind | 50 to 1 |
| Flush | 10 to 1 |
| Straight | 5 to 1 |
| 3 of a Kind | 1 to 1 |
| Two Pairs | 0 |
| Jacks or Better (Single Pair) | 0 |

The present invention can easily be adapted for play on an electronic gaming machine and it is to be understood and appreciated that such an adaptation and manner of use lies within the scope of the present invention.

My invention has been disclosed in terms of a preferred embodiment thereof, which provides a wagering game that combines poker and Blackjack in a manner that is of great novelty and utility. Various changes, modifications, and alterations in the teachings of the present invention may be contemplated by those skilled in the art without departing from the intended spirit and scope thereof. It is intended that the present invention encompass such changes and modifications.

What is claimed is:

1. A method of playing a wagering game, comprising the steps of:

providing at least one standard deck of physical playing cards;

placing a first wager by a player to participate in a first casino blackjack game;

placing a second wager by said player to participate in a second casino blackjack game;

placing a third wager to participate in a side bet;

after placing said first wager, second wager and third wager, a dealer dealing two face-up cards to said player forming a first player's hand for the first casino blackjack game, and said dealer dealing two face-up cards to said player forming a second player's hand for the second casino blackjack game and a single face-up card and a single face-down card forming a dealer's hand and resolving said side bet by evaluating said four face-up cards for said first and said second casino blackjack games according to a predetermined hierarchy of poker hands; after resolving said side bet, turning over said face-down card and playing said first casino blackjack game between said player's first hand and said dealer's hand, and resolving said first wager, then playing said second casino blackjack game between said player's second hand and said dealer's hand, and resolving the second wager.

2. The method of claim 1, and further comprising:

making a payout to a player on said third wager for one of a plurality of winning outcomes.

3. The method of claim 2, wherein said resolving said side bet further includes combining said single face-up card for said dealer with said four face-up cards for said first and said second casino blackjack games according to a predetermined hierarchy of 5-card poker hands.

4. The method of claim 3, wherein a single deck of playing cards is used and wherein the predetermined winning outcome is at least a pair of Jacks.

5. The method of claim 3, wherein at least six decks of playing cards are used and wherein the predetermined winning outcome is at least 3-of-a-kind.

6. A method of playing a blackjack game between at least one player and a dealer using at least one standard deck of playing cards, comprising the steps of:

providing at least one standard deck of physical playing cards;

each player placing a first wager to participate in a first casino blackjack game, optionally placing a second wager to participate in a second casino blackjack game, and optionally placing a bonus wager;

dealing each after placing said first wager, second wager and bonus wager player placing a first wager a first initial hand of two face-up playing cards, dealing each player placing a second wager a second an initial hand of two face-up playing cards, and dealing an initial hand of two playing cards to the dealer, a first card face-up and a second card face down; and resolving said optional bonus wager by evaluating said four initial face-up cards of a player dealt for placing said first wager and said optional second wager according to a predetermined hierarchy of poker hands; after resolving said bonus wager, turning over said face down card and playing said first casino blackjack game between said player's first hand and said dealer's hand, and resolving said first wager, then playing said second casino blackjack game between said player's second hand and said dealer's hand, and resolving the second wager.

7. The method of claim 6, and further comprising:

making a payout to a player on said optional bonus wager for one of a plurality of winning outcomes.

8. The method of claim 7, wherein the resolution of said optional bonus wager further includes adding said initial face-up card of said dealer and evaluating according to a pre-determined hierarchy of 5-card poker hands.

9. The method of claim 8, wherein the second wager is mandatory.

10. The method of claim 8, wherein a single deck of playing cards is used and wherein the predetermined winning outcome is at least a pair of Jacks.

11. The method of claim 8, wherein at least six decks of playing cards are used and wherein the predetermined winning outcome is at least 3-of-a-kind.

* * * * *